US008567427B1

(12) United States Patent
Milanovich

(10) Patent No.: US 8,567,427 B1
(45) **Date of Patent: *Oct. 29, 2013**

(54) BLOWOUT PREVENTERS USING PLATES PROPELLED BY EXPLOSIVE CHARGES

(71) Applicant: Philip John Milanovich, Phoenix, AZ (US)

(72) Inventor: Philip John Milanovich, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/685,957

(22) Filed: Nov. 27, 2012

Related U.S. Application Data

(63) Continuation-in-part of application No. 12/972,451, filed on Dec. 18, 2010, now Pat. No. 8,316,872.

(51) Int. Cl.
*E21B 43/11* (2006.01)
*F16K 17/14* (2006.01)

(52) U.S. Cl.
USPC ..... 137/68.13; 251/282; 166/55; 166/299

(58) Field of Classification Search
USPC ..... 251/1.1, 1.3, 282; 137/68.13; 166/55, 166/55.1, 55.2, 55.3, 297, 298, 299
See application file for complete search history.

(56) References Cited

U.S. PATENT DOCUMENTS

| | | | | |
|---|---|---|---|---|
| 1,543,456 | A | 6/1925 | Stirling | |
| 3,548,848 | A | 12/1970 | Stichling | |
| 3,766,979 | A | 10/1973 | Petrick | |
| 3,980,094 | A | 9/1976 | Schroder et al. | |
| 4,215,749 | A | 8/1980 | Dare et al. | |
| 4,523,639 | A | 6/1985 | Howard, Jr. | |
| 4,619,284 | A | 10/1986 | Delarue et al. | |
| 5,012,854 | A | 5/1991 | Bond | |
| 5,064,164 | A | 11/1991 | Le | |
| 5,156,212 | A * | 10/1992 | Bryant | 166/298 |
| 5,735,502 | A | 4/1998 | Levett et al. | |
| 6,354,568 | B1 | 3/2002 | Carruthers | |
| 6,739,570 | B2 | 5/2004 | Carlsen | |
| 7,243,713 | B2 * | 7/2007 | Isaacks et al. | 166/85.4 |
| 8,316,872 | B1 * | 11/2012 | Milanovich | 137/68.13 |
| 2009/0050828 | A1 | 2/2009 | Edwards | |

FOREIGN PATENT DOCUMENTS

| | | | |
|---|---|---|---|
| CA | 2 506 828 | A1 | 10/2006 |
| GB | 2 175 328 | A | 11/1986 |
| SU | 1427057 | A1 | 9/1988 |

* cited by examiner

*Primary Examiner* — Eric Keasel
(74) *Attorney, Agent, or Firm* — Swift & Swift; Stephen Christopher Swift

(57) ABSTRACT

Blowout preventer blocks, each having a channel and plate(s) to close it. The blocks are placed over a pipe through which oil or other fluid is escaping, so that the pipe is in their channels. Alongside the channel in each block are one or more plates, having diameters somewhat larger than the diameter of the channel. Explosive charges propel the plates into the channel to seal it off and stop the leak. When multiple blocks and/or multiple plates in a block are placed over a pipe, the assembly may be referred to as a "Christmas tree." There are passages that allow the plates to move into place to block the channel. Leading edges of the plates act as male elements that engage female reciprocal ends of the passages to create a seal. Grooves and tunnels in the plates allow fluid to escape into the pipe to ensure a seal.

20 Claims, 11 Drawing Sheets

BLOWOUT PREVENTERS USING PLATES PROPELLED BY EXPLOSIVE CHARGES

CROSS REFERENCE TO RELATED APPLICATION

This application is a Continuation-In-Part of Regular Utility patent application Ser. No. 12/972,451, filed Dec. 18, 2010, which is incorporated herein by reference.

BACKGROUND OF THE INVENTION

1. Field of the Invention

The present invention relates to apparatus and methods for preventing the escape of fluid from wells or pipes.

2. Description of the Prior Art

As shown by recent events in the Gulf of Mexico, oil well blowouts are a serious threat to the environment, and can be very costly. Current blowout preventers can be unreliable. While there are numerous prior inventions of blowout preventers, none are equivalent to the present invention.

U.S. Pat. No. 1,543,456, issued on Jun. 23, 1925, to Robert Stirling, discloses an early blowout preventer, without the explosive charges of the instant invention.

U.S. Pat. No. 3,548,848, issued on Dec. 22, 1970, to Gerhardt C. Stichling, discloses explosive actuated valves, but does not disclose their use in a blowout preventer as in the instant invention.

U.S. Pat. No. 3,766,979, issued on Oct. 23, 1973, to John T. Petrick, discloses a well casing cutter and sealer, but does not disclose the grooves and tunnels in the plates of the instant invention.

U.S. Pat. No. 3,980,094, issued on Sep. 14, 1976, to Fritz Schröder and Klaus Rössel, discloses a quick action slide valve with a sliding plate, but does not disclose the grooves and tunnels in the plates of the instant invention.

U.S. Pat. No. 4,215,749, issued on Aug. 5, 1980, to Roy R. Dare and Jeff L. Merten, discloses a gate valve for shearing workover lines to permit shutting a well, using a shear plate, but does not disclose the grooves and tunnels in the plates of the instant invention.

U.S. Pat. No. 4,523,639, issued on Jun. 18, 1985, to Roland M. Howard, Jr., discloses ram-type blowout preventers, which a locking mechanism to hold the plate in the channel after the pipe has been cut, but does not disclose the grooves and tunnels in the plates of the instant invention.

U.S. Pat. No. 4,619,284, issued on Oct. 28, 1986, to Jean-Jacques Delarue and Claude Ego, discloses a pyrotechnic valve that may either close an initially open pipe or open an initially closed pipe, but does not disclose its use in a blowout preventer.

U.S. Pat. No. 5,012,854, issued on May 7, 1991, to John A. Bond, discloses a pressure release valve for a subsea blowout preventer that is hydraulically operated. The vents and valves in the instant invention are distinguishable, in that they are not used in a system that is hydraulically operated.

U.S. Pat. No. 5,064,164, issued on Nov. 12, 1991, to Tri C. Le, discloses a blowout preventer with metal inserts resembling the plates in the instant invention, but does not disclose explosive actuation as in the instant invention.

U.S. Pat. No. 5,735,502, issued on Apr. 7, 1998, to Bryce A. Levett and Mike C. Nicholson, discloses a blowout preventer with ram blocks resembling the plates in the instant invention, but it is hydraulically actuated, rather than explosively actuated as in the instant invention.

U.S. Pat. No. 6,354,568, issued on Mar. 12, 2002, to Alec Carruthers, discloses a sliding plate valve, but does not disclose explosive actuation as in the instant invention.

U.S. Pat. No. 6,739,570, issued on May 25, 2004, to Hans-Paul Carlsen, discloses a valve element, which may be used for closing a channel in a blowout preventer, but does not disclose explosive actuation as in the instant invention.

U.S. Patent Application Publication No. 2009/0050828, published on Feb. 26, 2009, to Jeffrey Charles Edwards, discloses blowout preventers with a housing having a throughbore resembling the channel in the instant invention, which may be closed by a pair of opposed rams, but does not disclose explosive actuation as in the instant invention.

British Patent No. 2 175 328, published on Nov. 26, 1986, to Richard Theodore Mitchell, discloses an oil well drilling apparatus, including a blowout preventer stack, without the explosive charges of the instant invention.

Canadian Patent No. 2 506 828, published on Oct. 29, 2006, inventors Dean Foote and Scott Delbridge, discloses a blowout preventer with rams that are hydraulically rather than explosively actuated, as in the instant invention.

Soviet Patent No. 1427057, published Sep. 30, 1988, inventors Y. U. A. Gavrilin, L. M. Torsunov and B. V. Venedictov, discloses a blowout preventer with a flat blocking gate.

None of the above inventions and patents, taken either singly or in combination, is seen to describe the instant invention as claimed.

SUMMARY OF THE INVENTION

The present invention is a blowout preventer including one or more blocks (made of metal, concrete or other suitable material), having a cylindrical channel. The blocks can be placed over (or onto) a well pipe or other pipe through which oil (or gas or other fluid) is flowing, so that the pipe is in the metal or concrete block, or at an end of the cylindrical channel. The oil will initially flow through the channel. Alongside the channel are one or more circular plates, having diameters somewhat larger than the diameter of the channel. Explosive charges propel the plates into the channel to seal it off and stop the oil leak. The explosive charges may be ignited by a radio, electric or sonic signal or other suitable means. There are passages for the plates that are at right angles to the cylindrical channel, that allow the plates to move into place to block the channel, while preventing them from moving too far and passing by the channel. Ratchets or plate reversal stops keep the plates from moving back after they have blocked the channel. Vents allow gas from the explosive charges to escape. The plates may be grooved and/or tunneled, and the end of the passage (or female receptive) that stops the plate may be grooved. The plates should be thick enough to stop the flow of oil, but not so thick that the well cannot be later reopened by drilling through the plates.

Accordingly, it is a first object of the invention to prevent damage to the environment from oil well blowouts.

It is a second object of the invention to prevent economic loss from oil well blowouts.

It is a third object of the invention to prevent damage to the environment from any kind of fluid escaping from a pipe.

It is a fourth object of the invention is to prevent economic loss from any kind of fluid escaping from a pipe.

It is a fifth object of the invention to create a safer environment for any fluid carrying pipe or pipe-like structure.

It is a sixth object of the invention to provide a shutoff mechanism that can be reopened.

It is a seventh object of the invention to provide a shutoff mechanism that can be repeatedly opened and shut.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention a blowout preventer with one or more explosively actuated plates.

Figure 1:
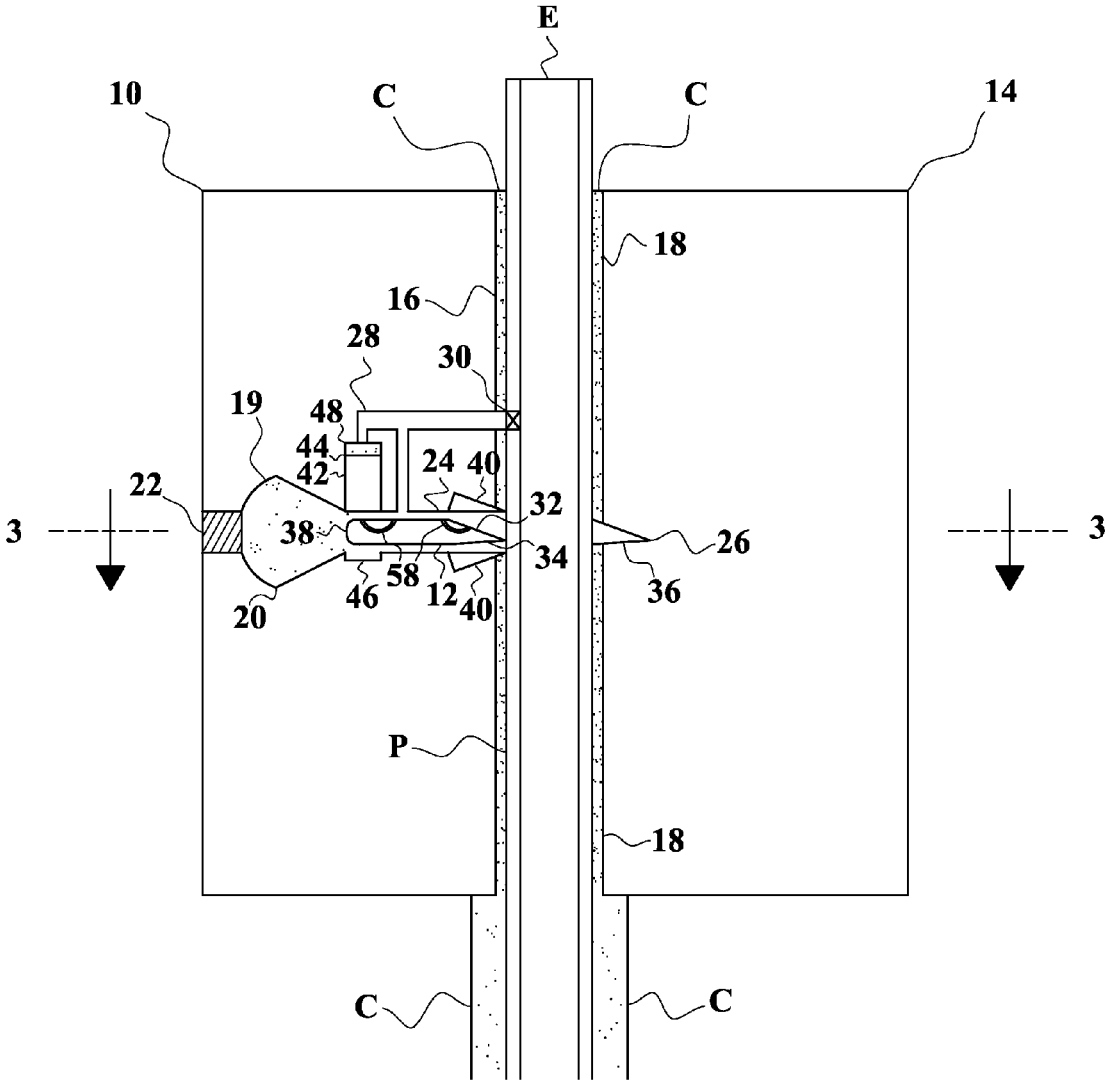
FIG. 1 is a vertical sectional view drawn along lines 1-1 of FIG. 3 of the first preferred embodiment of the invention, showing the position of the plate before the explosive charge has been fired.
Figure 3:
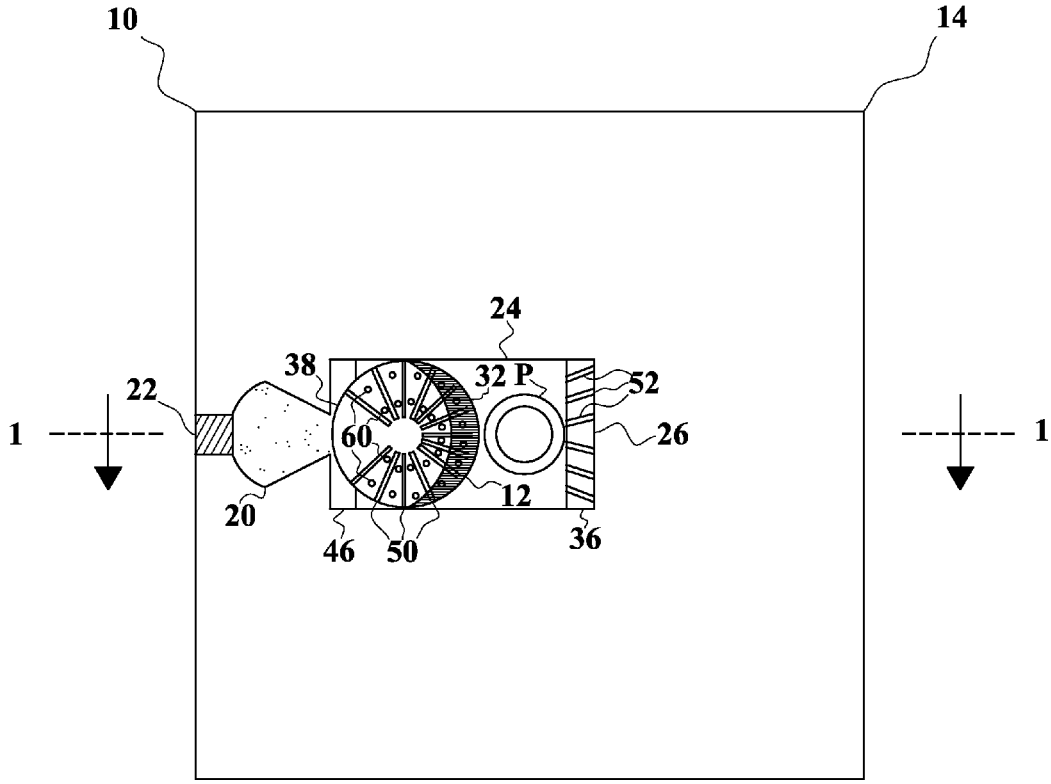
FIG. 3 is a horizontal sectional view drawn along lines 3-3 of FIG. 1 of the first preferred embodiment of the invention, showing the position of the plate before the explosive charge has been fired.

FIG. 1 is a vertical sectional view drawn along lines 1-1 of FIG. 3 of the first preferred embodiment of the invention 10, showing the position of the plate 12 before the explosive charge has been fired. The block 14 has a cylindrical channel 16 with ends 18 configured so that it can be inserted over the open end E of pipe P through which fluid (such as petroleum or natural gas) can escape. (The pipe may be a well pipe or riser, undersea or on land.) An explosive charge 19 in chamber 20 when fired will propel the plate across the channel to block the flow of fluid. A receiver/ignitor 22 when ignite the explosive charge when it receives a radio, electrical, sonic or other signal to do so. When the charge is fired, the plate will move in passage 24 with far end 26. Vents 28 will allow gases from the charge to escape through one-way valves 30 into the pipe above the plate. The upper edge 32 of the side of the plate facing the pipe is inclined so that it can cut through the walls of the pipe, and to enable fluid to escape upward in the pipe. The lower edge 34 of the side of the plate facing the pipe is slightly inclined, and the lower edge 36 of the far end of the passage is also slightly inclined, to insure that the plate can move through the passage and close off the pipe even if the edge of the plate and the far end of the passage become slightly misaligned. The edge 38 of the plate facing the charge is blunt or rounded, so that the plate will be propelled by the charge. Plate reversal stops 40 are above and below the plate before the charge is fired. A back flow preventer 42 is above the plate before the charge is fired, in the back flow preventer passage 44 with lower end 46 below the plate. There is a back flow preventer charge 48 in the back flow preventer passage above the back flow preventer before the charge 19 is fired. When the block is placed over and around the pipe, cement C is placed over the pipe and the side of the block into which the pipe is inserted, and allowed to harden, to create a tight seal and prevent fluids (such as seawater or oil) from leaking in or out. Any other suitable means may be substituted for cement to seal any space between the pipe and channel and retain the block on the pipe. The block is made of metal, concrete, or other suitable material.

Figure 2:
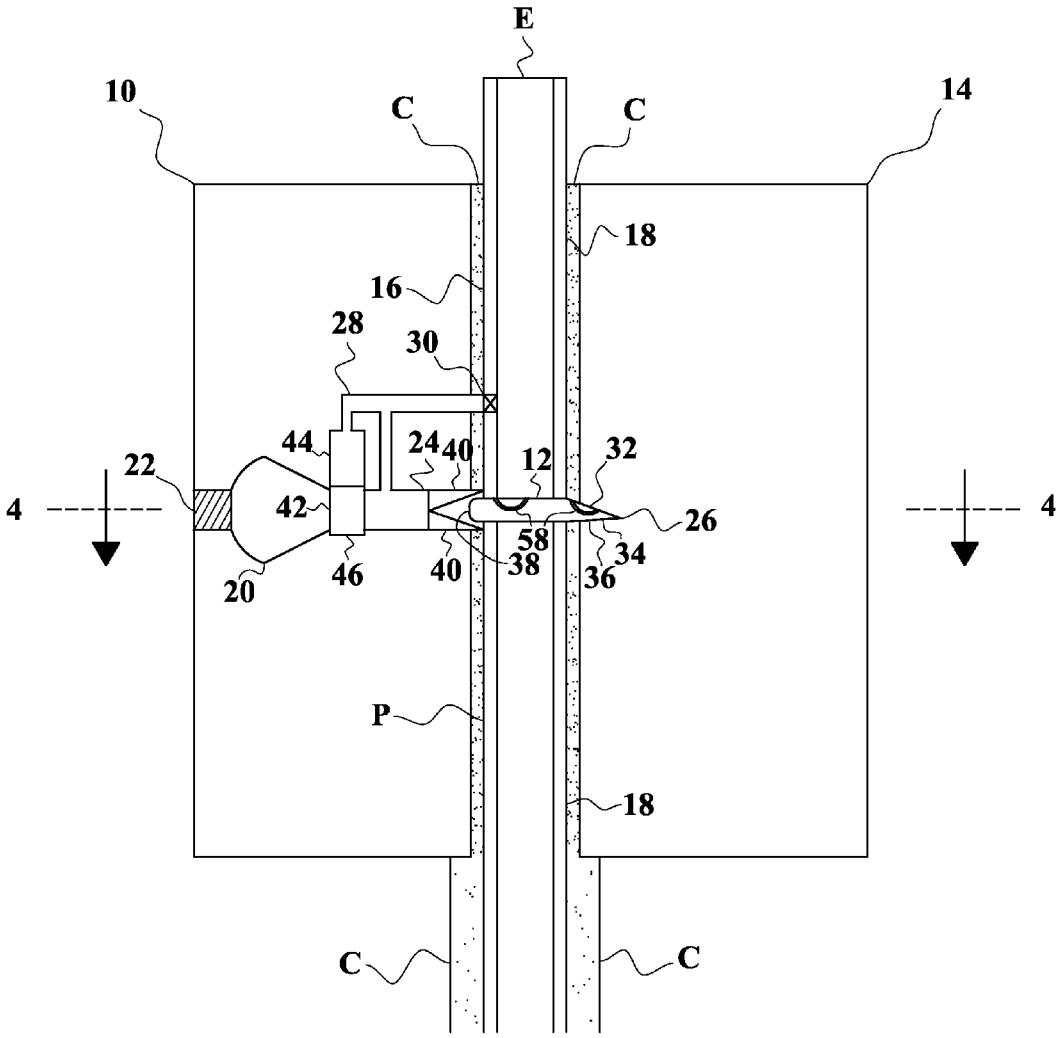
FIG. 2 is a vertical sectional view drawn along lines 2-2 of FIG. 4 of the first preferred embodiment of the invention, showing the position of the plate after the explosive charge has been fired.
Figure 4:
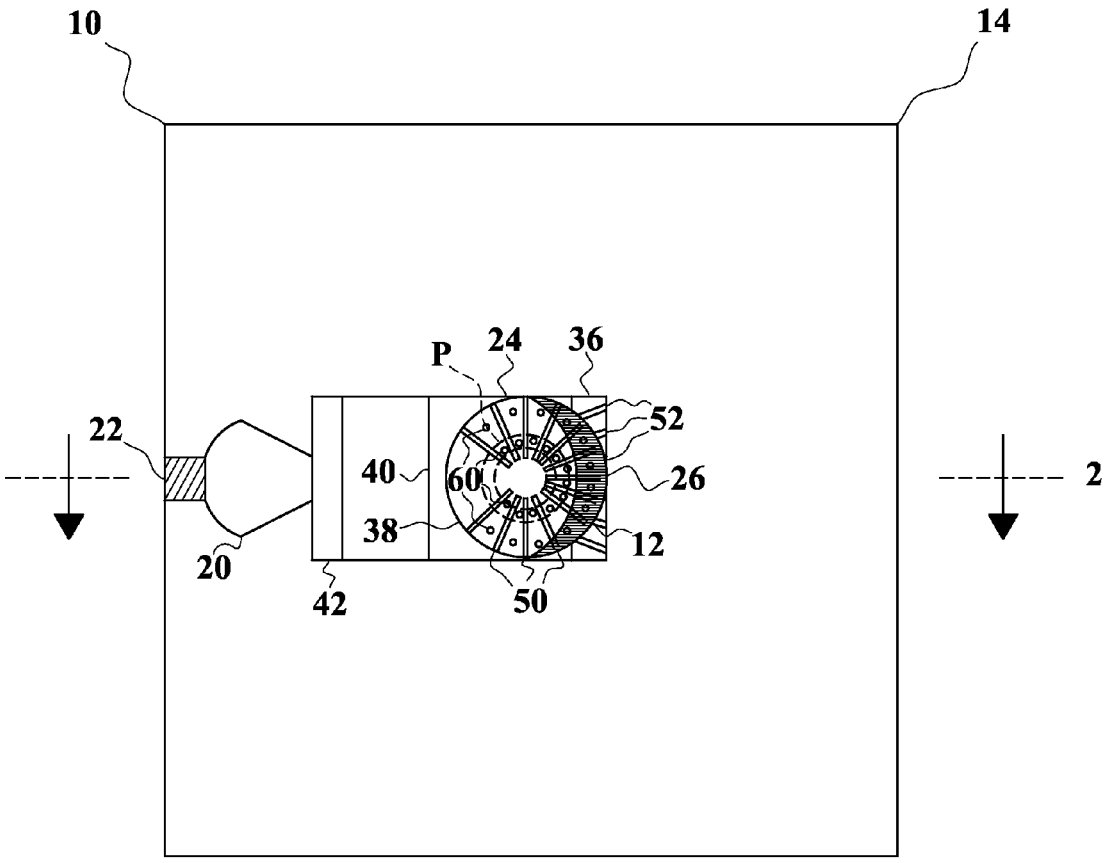
FIG. 4 is a horizontal sectional view drawn along lines 4-4 of FIG. 2 of the first preferred embodiment of the invention, showing the position of the plate after the explosive charge has been fired.

FIG. 2 is a vertical sectional view drawn along lines 2-2 of FIG. 4 of the first preferred embodiment of the invention, showing the position of the plate 12 after the explosive charge has been fired. The far end 26 of the passage 24 prevents the plate from moving too far and bypassing the channel. The inclination of the lower edge 34 of the plate should match the inclination of the lower surface 36 of the far end of the passage, to more effectively prevent the escape of fluid. The upper edge 32 and lower edge 34 of the plate form a knife-like blade that is a male element, while the upper and lower surfaces of the end of the passage form a female element, that matingly engage to create a tight seal that prevents fluid from escaping. The plate reversal stops 40 move into the passage and prevent the plate from moving back, locking it in place. The plate reversal stops may be actuated by springs that are released by a trigger mechanism or motion detector when the plate passes, by a timer after the charge is fired, or by any other suitable means. (Alternatively, other locking mechanisms may be used to keep the plate in place.) The charge above the back flow preventer is fired after the charge in chamber 20, and propels the back flow preventer 42 through its passage 44 until it rests against far end 46, thus sealing the passage behind the plate and preventing fluid from escaping. A locking pin or other suitable mechanism may keep the back flow preventer in place. The charge above the back flow preventer may be fired in response to a trigger mechanism or motion detector when the plate passes, by a timer after the main charge is fired, or by any other suitable means. Gases from the charge ignited above the back flow preventer can escape through vents 28. Tunnels 58 passing through upper portions of the plates enable some of the fluid to escape from near edges of the plates to near the centers of the plates into the pipe, above that plates that are blocking its flow. The bottoms of the plates are solid, with no tunnels.

FIG. 3 is a horizontal sectional view drawn along lines 3-3 of FIG. 1 of the first preferred embodiment of the invention, showing the position of the plate before the explosive charge has been fired. Grooves or channels 50 radiate outward from the center of the upper surface of the plate 12, except on the side of the plate facing the charge. There are also grooves or channels 52 in the far end of the passage. Openings 60 at opposite ends of the tunnels though the upper portion of the disk are also shown.

FIG. 4 is a horizontal sectional view drawn along lines 4-4 of FIG. 2 of the first preferred embodiment of the invention, showing the position of the plate after the explosive charge has been fired. It can be seen that the plate 12 is circular and has a somewhat larger diameter than the cylindrical pipe P, so that it can effectively seal the pipe and stop the flow of fluid. The grooves or channels 50 in the plate enable fluid to escape into the interior of the pipe above the plate as the pipe is cut and blocked off by the plate. The grooves and tunnels prevent fluid in the passage from impeding movement of the plate, to ensure unobstructed closure so that it can cut off the flow in the pipe. The grooves and tunnels do not go all the way to the leading edge of the plate, to ensure a seal with the end of the passage. The plate is preferably made of hardened metal, which is thick and hard enough to cut through the pipe and stop the flow, but thin and soft enough that it can be drilled through to reopen an oil or gas well.

There may be a plurality of plates in a single block. There may be a plurality of blocks used on a single pipe or well. This arrangement may be referred to as a "Christmas tree". This will allow the blowout preventer to be used multiple times to prevent multiple blowouts, as it may not be necessary to fire all of the plates to stop a blowout, and the plates that have been fired may be drilled through to reopen the well, while leaving the unfired plates in their original positions for future use.

Figure 5:
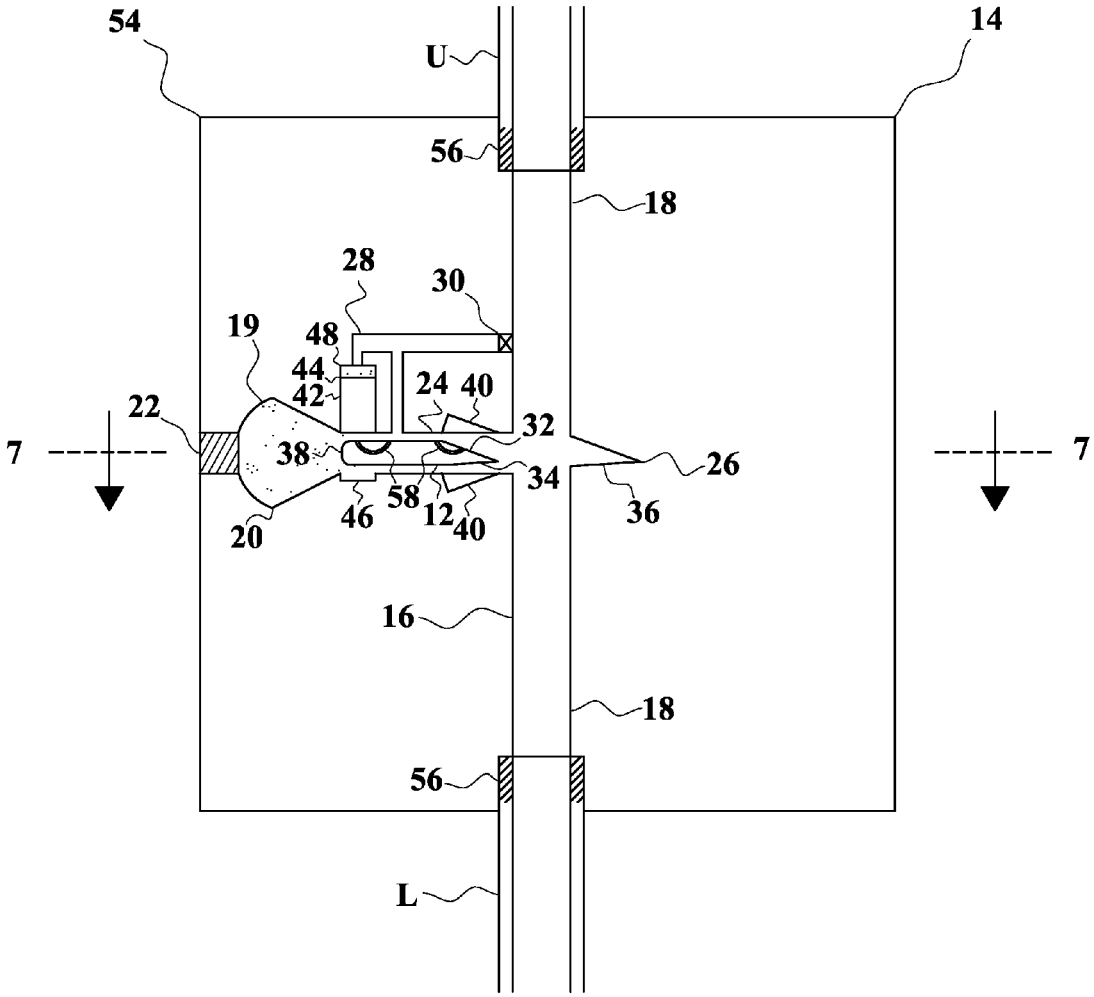
FIG. 5 is a vertical sectional view drawn along lines 5-5 of FIG. 7 of the second preferred embodiment of the invention, showing the position of the plate before the explosive charge has been fired.
Figure 7:
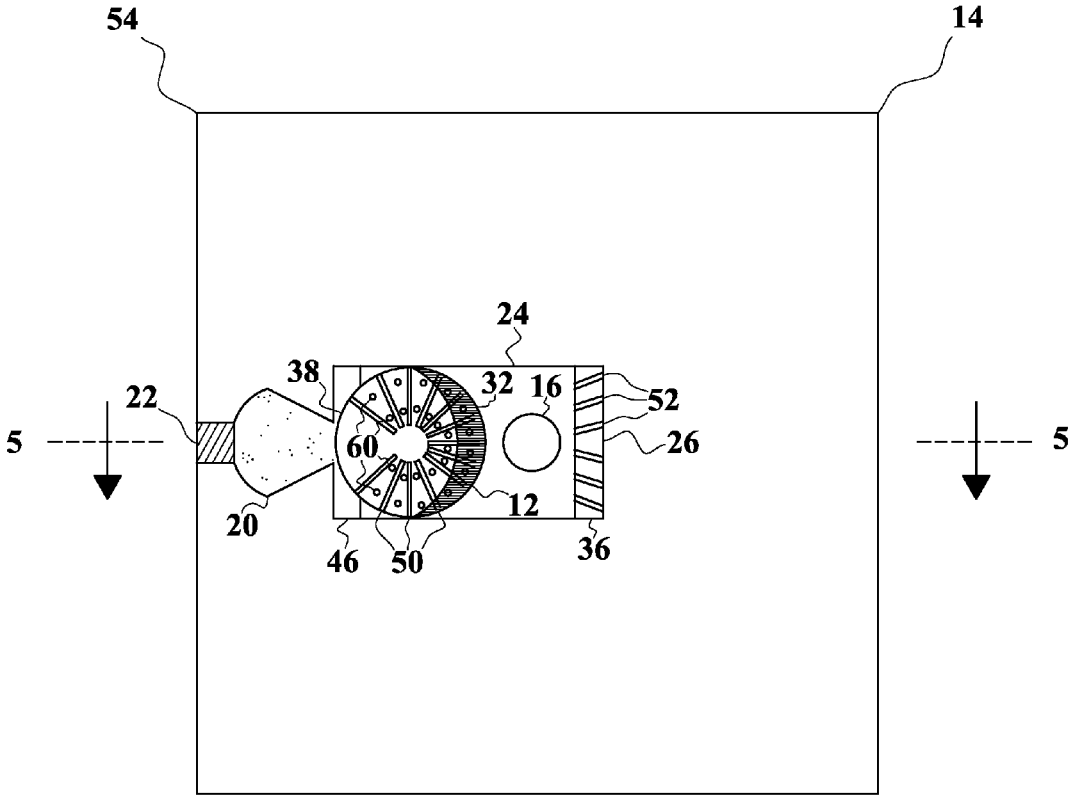
FIG. 7 is a horizontal sectional view drawn along lines 7-7 of FIG. 5 of the second preferred embodiment of the invention, showing the position of the plate before the explosive charge has been fired.

FIG. 5 is a vertical sectional view drawn along lines 5-5 of FIG. 7 of the second preferred embodiment of the invention 54, showing the position of the plate before the explosive charge has been fired. The second preferred embodiment is the same as the first preferred embodiment, except that there is no pipe going through the block, and cement is not used. The block 14 is screwed over the lower pipe L, and the upper pipe U is screwed into the block, using screw threads 56. The fluid flows directly through the channel 16 between the lower pipe and the upper pipe. The lower pipe may be well pipe. The upper pipe may be a riser.

Figure 6:
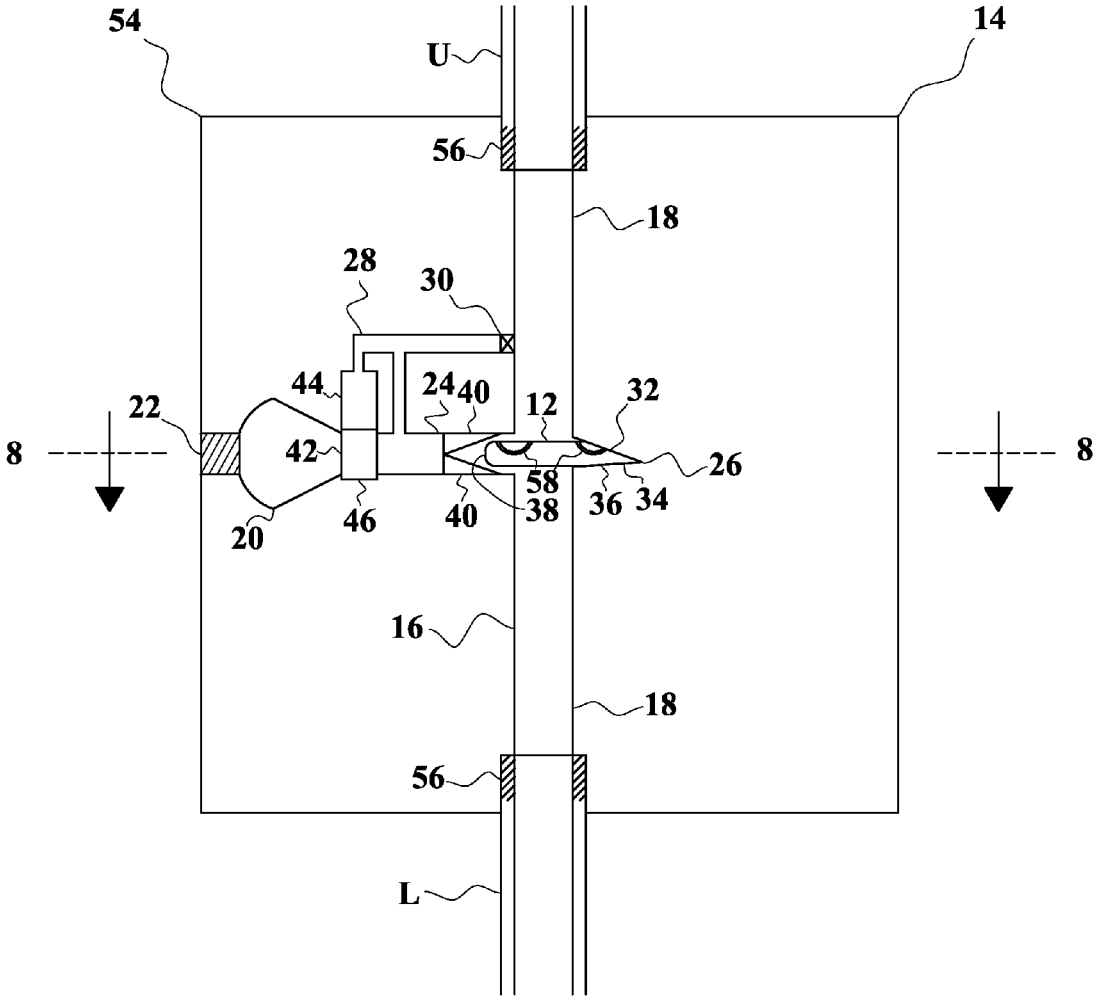
FIG. 6 is a vertical sectional view drawn along lines 6-6 of FIG. 8 of the second preferred embodiment of the invention, showing the position of the plate after the explosive charge has been fired.
Figure 8:
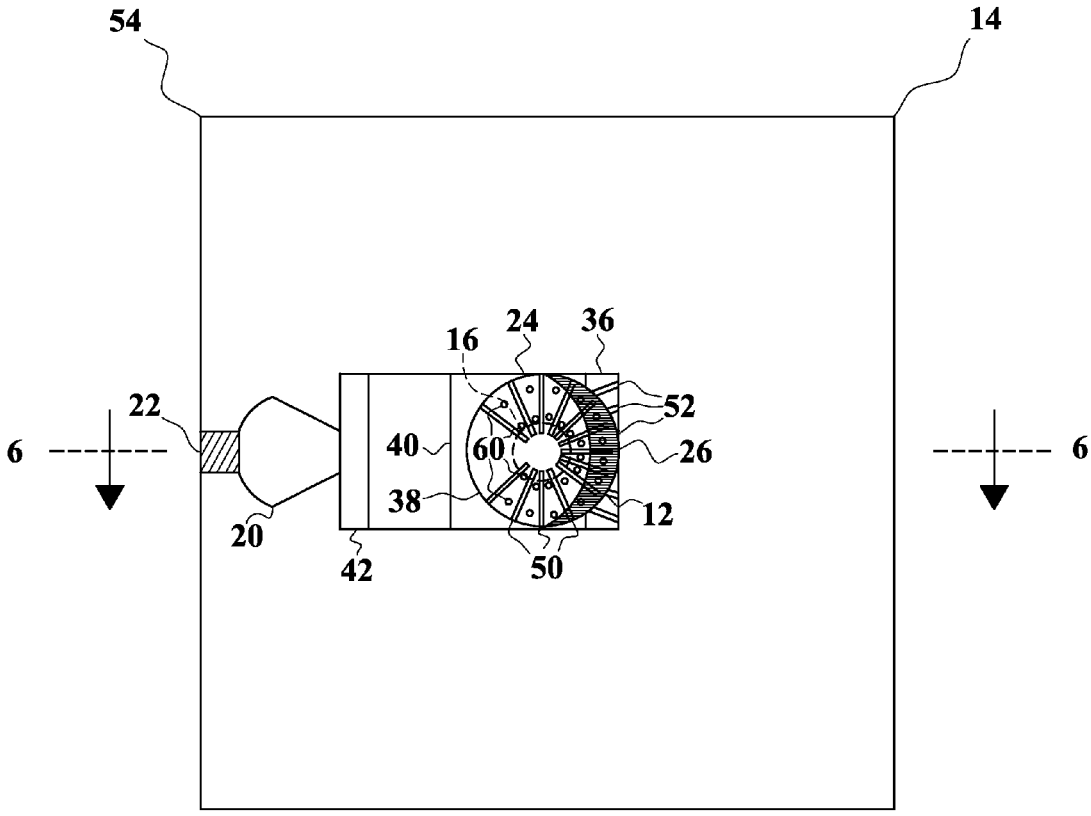
FIG. 8 is a horizontal sectional view drawn along lines 8-8 of FIG. 6 of the second preferred embodiment of the invention, showing the position of the plate after the explosive charge has been fired.

FIG. 6 is a vertical sectional view drawn along lines 6-6 of FIG. 8 of the second preferred embodiment of the invention, showing the position of the plate after the explosive charge has been fired. The plate does not need to cut through a pipe, but blocks the channel directly. As it does not need to cut through the pipe, the plate may be thinner than in the first preferred embodiment, which will make it easier to drill through to reopen the well.

FIG. 7 is a horizontal sectional view drawn along lines 7-7 of FIG. 5 of the second preferred embodiment of the invention, showing the position of the plate before the explosive charge has been fired. FIG. 8 is a horizontal sectional view drawn along lines 8-8 of FIG. 6 of the second preferred embodiment of the invention, showing the position of the plate after the explosive charge has been fired.

Figure 9:
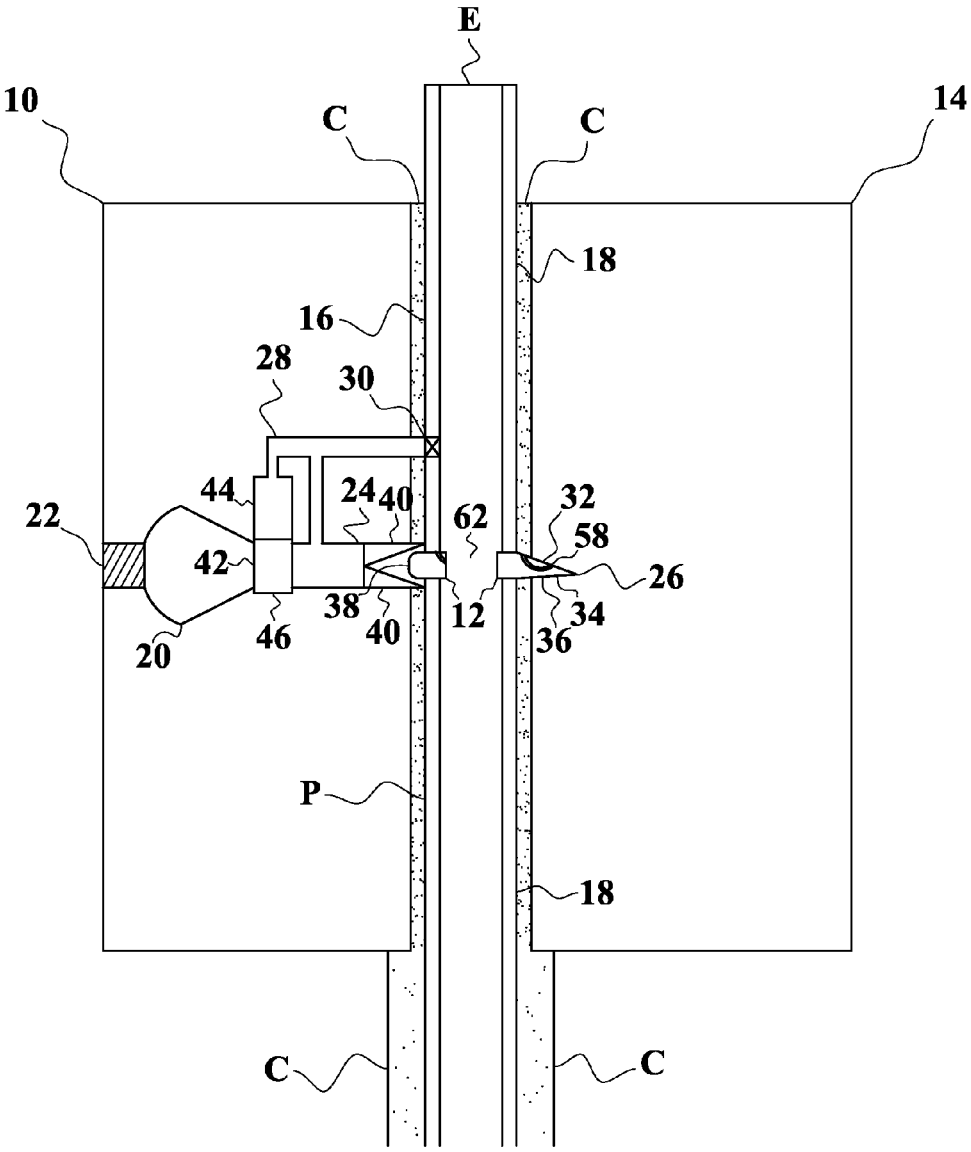
FIG. 9 is a vertical sectional view of the first preferred embodiment of the invention, showing the plate after it has been drilled through to reopen the pipe.
Figure 10:
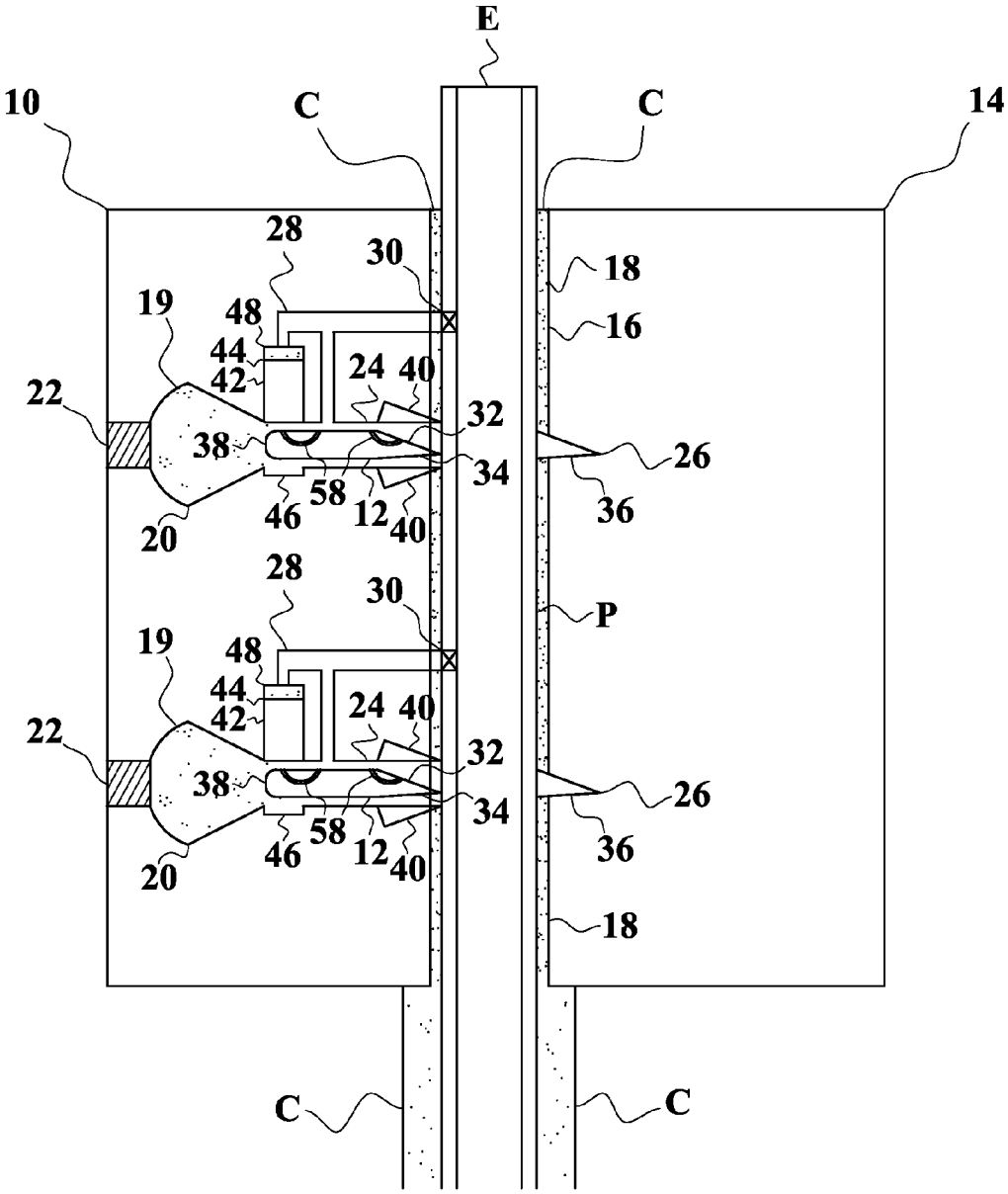
FIG. 10 is a vertical sectional view of the first preferred embodiment of the invention, showing a block with two plates.
Figure 11:
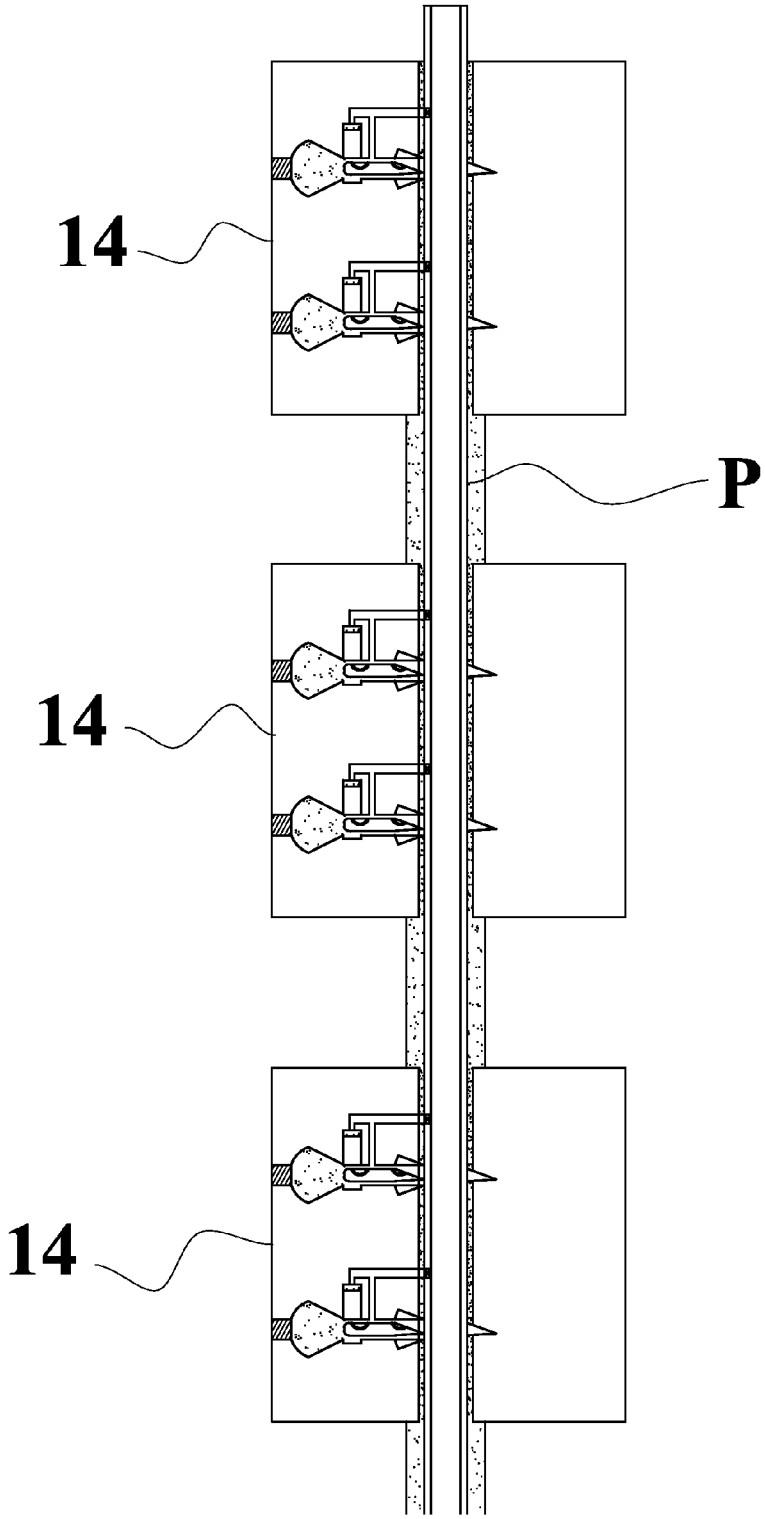
FIG. 11 is a vertical sectional view of the first preferred embodiment of the invention, showing three blocks on a pipe.

FIG. 9 is a vertical sectional view of the first preferred embodiment of the invention, showing the plate after it has been drilled through to reopen the pipe. FIG. 10 is a vertical sectional view of the first preferred embodiment of the invention, showing a block with two plates. FIG. 11 is a vertical sectional view of the first preferred embodiment of the invention, showing three blocks on a pipe. There may be similar arrangements for the second preferred embodiment of the invention.

It is to be understood that the present invention is not limited to the embodiments described above, but encompasses any and all embodiments within the scope of the following claims.

I claim:

1. A blowout preventer, comprising:

one and only one block, with the block having a channel, with the channel having at least one end that is dimensioned and configured so that it can be inserted over a portion of a pipe through which fluid can escape;

a plurality of plates in the block, initially to one side of the channel;

an explosive charge for each of the plates, that when fired, propels the plates across the channel to block the flow of the fluid; and a passage in each of the blocks for each of the plates, that allows the plates to move into place to block the channel, said passage having a far end that prevents the plates from moving too far and bypassing the channel;

wherein grooves in surfaces of the plates enable some of the fluid to escape into the pipe above the plates that are blocking its flow.

2. The blowout preventer according to claim 1, wherein back flow preventers prevent the fluid from escaping from the passages in which the plates move after the explosive charges are fired.

3. The blowout preventer according to claim 1, wherein grooves in surfaces of the passages in which the plates move after the explosive charges are fired, enable some of the fluid to escape into the pipe above the plates that are blocking its flow.

4. The blowout preventer according to claim 1, wherein tunnels passing through upper portions of the plates under their surfaces enable some of the fluid to escape from near edges of the plates to near centers of the plates into the pipe above the plates that are blocking its flow.

5. The blowout preventer according to claim 1, wherein:

the plates have sloped edges that matingly engage sloped surfaces of the ends of the passages through which the plates move after the explosive charges are fired, sealing off the flow of fluid through the pipe; and locking mechanisms capable of holding the plates in place after they are propelled across the channels in the blocks.

6. The blowout preventer according to claim 1, wherein:

locking mechanisms capable of holding the plates in place after they are propelled across the channels in the blocks.

7. Blowout preventers, comprising:

a plurality of blocks, with each of the blocks having a channel, with the channel having at least one end that is dimensioned and configured so that it can be inserted over portion of a pipe through which fluid can escape;

one or more plates in each of the blocks, initially to one side of the channel in each block;

an explosive charge for each of the plates, that when fired, propels the plate across the channel to block the flow of the fluid; and a passage in each of the blocks for each of the plates, that allows the plate to move into place to block the channel, said passage having a far end that prevents the plate from moving too far and bypassing the channel;

wherein grooves in surfaces of the plates enable some of the fluid to escape into the pipe above the plates that are blocking its flow.

8. The blowout preventers according to claim 7, wherein back flow preventers prevent the fluid from escaping from the passages in which the plates move after the explosive charges are fired.

9. The blowout preventers according to claim 7, wherein there are grooves in surfaces of the passages in which the plates move after the explosive charges are fired, that enable some of the fluid to escape into the pipe above the plates that are blocking its flow.

10. The blowout preventers according to claim 7, wherein tunnels passing through upper portions of the plates under their surfaces enable some of the fluid to escape from near edges of the plates to near centers of the plates into the pipe above the plates that are blocking its flow.

11. The blowout preventers according to claim 7, wherein the plates have sloped edges that matingly engage sloped surfaces of the ends of the passages through which the plates move after the explosive charges are fired, sealing off the flow of fluid through the pipe.

12. The blowout preventers according to claim 7, wherein locking mechanisms capable of holding the plates in place after they are propelled across the channels in the blocks.

13. A method of preventing a blowout, comprising the steps of:

placing one or more blocks around portions of a pipe through which fluid can escape, with each block having a channel that surrounds the pipe, and with each block having one or more plates that are initially to one side of the channel, and an explosive charge for each plate, that when fired, can propel the plate across the channel to block flow of the fluid;

retaining the one or more blocks on the pipe; and firing one or more of the explosive charges in one or more of the blocks;

wherein grooves in surfaces of the plates enable some of the fluid to escape into the pipe above the plates that are blocking its flow.

14. The method of preventing a blowout according to claim 13, wherein back flow preventers prevent the fluid from escaping from passages in which the plates move after the explosive charges are fired.

15. The method of preventing a blowout according to claim 13, wherein there are passages in which the plates move after the explosive charges are fired.

16. The method of preventing a blowout according to claim 15, wherein the plates have sloped edges that matingly engage sloped ends of the passages, sealing off the flow of fluid through the pipe.

17. The method of preventing a blowout according to claim 15, wherein there are grooves in surfaces of the passages that enable some of the fluid to escape into the pipe above the plates that are blocking its flow.

18. The method of preventing a blowout according to claim 13, wherein tunnels passing through upper portions of the plates under their surfaces enable some of the fluid to escape from near edges of the plates to near centers of the plates into the pipe above the plates that are blocking its flow.

19. The method of preventing a blowout according to claim 13, comprising the further step of drilling through one or more plates that are blocking the flow of fluid through the pipe, allowing fluid to again flow through the pipe.

20. The method of preventing a blowout according to claim 13, wherein the plates are locked in place after they are propelled across the channels in the blocks.

* * * * *